US008985251B2

(12) United States Patent
Carney

(10) Patent No.: US 8,985,251 B2
(45) Date of Patent: Mar. 24, 2015

(54) MOBILE REFUGE CHAMBER

(76) Inventor: Gary Lee Carney, Poca, WV (US)

( * ) Notice: Subject to any disclaimer, the term of this patent is extended or adjusted under 35 U.S.C. 154(b) by 296 days.

(21) Appl. No.: 13/439,533

(22) Filed: Apr. 4, 2012

(65) Prior Publication Data

US 2013/0264131 A1 Oct. 10, 2013

(51) Int. Cl.

| | |
|---|---|
| ***E21F 11/00*** | (2006.01) |
| ***E04H 9/12*** | (2006.01) |
| ***A62B 31/00*** | (2006.01) |

(52) U.S. Cl.

CPC ..... *A62B 31/00* (2013.01); *E21F 11/00* (2013.01)

USPC ..... 180/9.42; 299/12

(58) Field of Classification Search

CPC ..... E21F 11/00; E21F 13/004; E04H 9/12

USPC ..... 180/9.1, 9.23, 169.3

See application file for complete search history.

(56) References Cited

U.S. PATENT DOCUMENTS

| | | | | |
|---|---|---|---|---|
| 4,650,017 | A * | 3/1987 | Pelletier et al. | 180/9.1 |
| 4,815,363 | A * | 3/1989 | Harvey | 454/168 |
| 5,113,958 | A * | 5/1992 | Holden | 180/9.4 |
| 8,007,047 | B2 * | 8/2011 | Kennedy et al. | 299/12 |
| 8,678,515 | B2 * | 3/2014 | Kennedy et al. | 299/12 |
| 8,695,285 | B2 * | 4/2014 | Reinmann et al. | 52/79.5 |
| 2007/0200420 | A1 * | 8/2007 | McCormick | 299/95 |
| 2008/0106137 | A1 * | 5/2008 | Paton-Ash et al. | 299/12 |
| 2008/0196329 | A1 * | 8/2008 | Kennedy et al. | 52/169.6 |
| 2009/0133730 | A1 * | 5/2009 | McVey | 135/93 |
| 2010/0018391 | A1 * | 1/2010 | Whittaker et al. | 95/23 |
| 2010/0071393 | A1 * | 3/2010 | Tatton et al. | 62/121 |
| 2014/0076324 | A1 * | 3/2014 | Han et al. | 128/205.26 |

OTHER PUBLICATIONS

"Strata Safety Chambers for coal mines" by Strata Safety Products [4 pages].

MineARC Systems Coal Mine Refuge (The CoalSAFE) [12 pages].

VaHoose, Ed, "A Lifeline in the Dark. New Mine Disaster Safety Simulator Provides Miners with a Realistic Experience" Illinois Country Living, Aug. 2009 [6 pages].

* cited by examiner

*Primary Examiner* — Joseph Rocca
*Assistant Examiner* — Gabriela C Craciun
(74) *Attorney, Agent, or Firm* — Davidson Berquist Jackson & Gowdey LLP

(57) ABSTRACT

A self-movable mine refuge chamber powered by a drive assembly, preferably in the form of a set of crawler or tractor mechanisms, mounted on the chamber, so that the chamber can be moved through the mine without use of any other motive force. The drive assembly further includes a tilt assembly so that one end of the other of the chamber can also be tilted to establish a modified height profile to permit obstacles along the path to be negotiated. The drive assembly is powered by an on-board, detachable power supply module and, using controls from outside the chamber, the chamber can be maneuvered through working tunnels or roadways, crosscuts, or other passageways within the mine, and be positioned and repositioned at will.

18 Claims, 16 Drawing Sheets

MOBILE REFUGE CHAMBER

COPYRIGHT NOTICE

A portion of the disclosure of this patent document contains material that is subject to copyright or mask work protection. The copyright or mask work owner has no objection to the facsimile reproduction by anyone of the patent document or the patent disclosure, as it appears in the Patent and Trademark Office patent file or records, but otherwise reserves all copyright or mask work rights whatsoever.

FIELD OF THE DISCLOSURE

This disclosure relates to refuge chambers for use in mines or other underground areas where workers require a possible escape, rescue or a protection device that, and more specifically to a mobile refuge chamber that is independently drivable within a mine environment.

INTRODUCTION

Glossary: As Used Throughout this Document

The phrase "refuge chamber" shall mean an enclosed, reinforced, and protected device for use in a mine environment within which light, air, water, waste disposable, food, medical and other types of support supplies are stored, and within which a livable environment for a limited amount of time is provided.

The term "mobile refuge chamber" shall mean a refuge chamber that is provided with its own controlled mobility system by which the chamber is itself independently movable within a mine environment without the need for other towing or moving equipment.

DESCRIPTION OF PRESENTLY PREFERRED EXAMPLES OF THE INVENTION

Brief Description of Figures

The invention is better understood by reading the following detailed description with reference to the accompanying drawings in which.

DESCRIPTION

A. Overview

Figure 1:
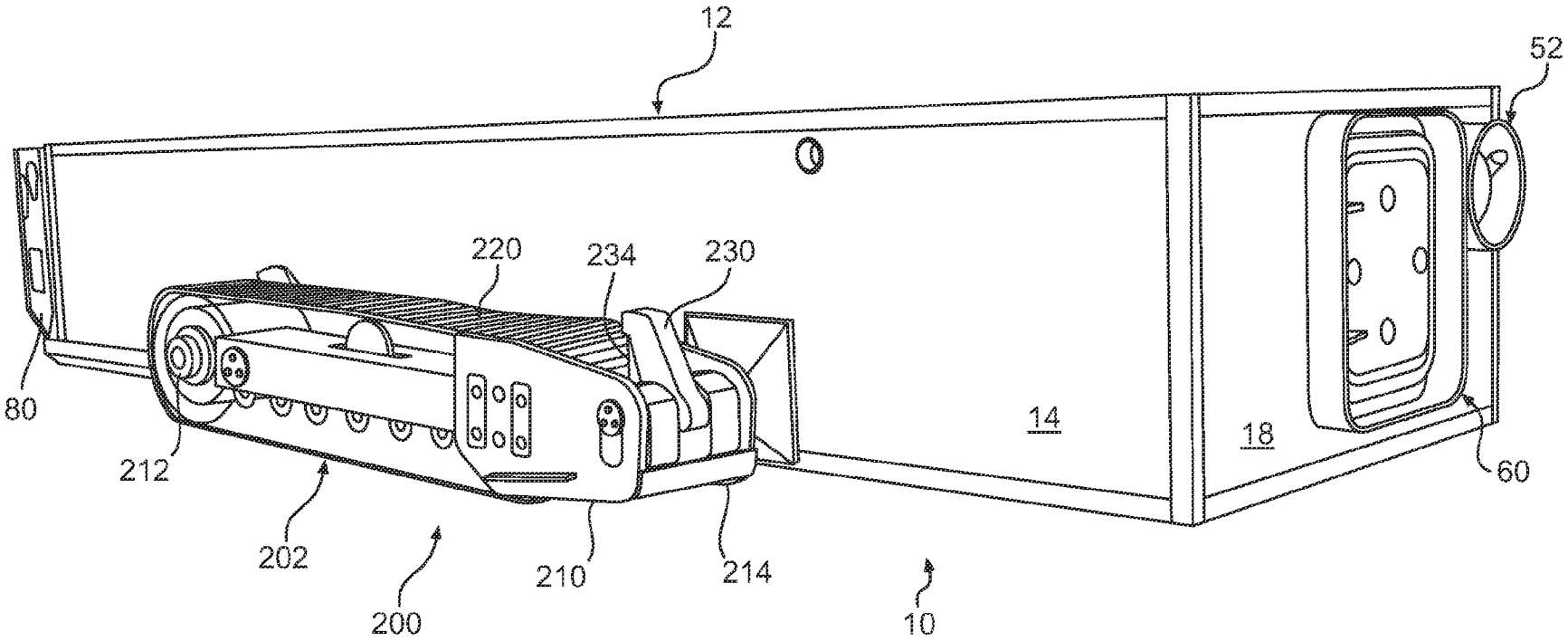
FIG. 1 is a side perspective view of the refuge chamber according to the present invention.
Figure 2:
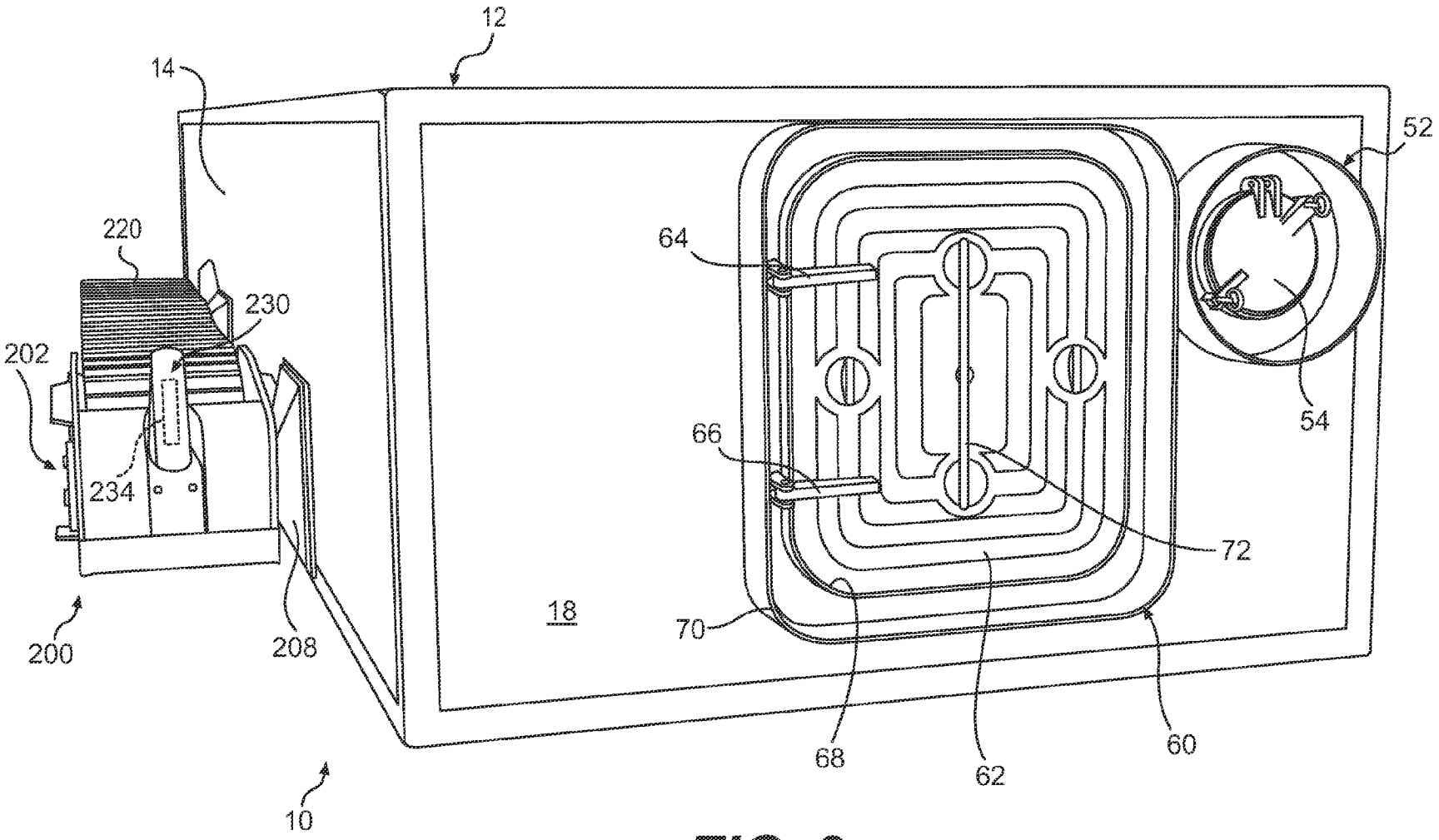
FIG. 2 is a frontal perspective view thereof.
Figure 3:
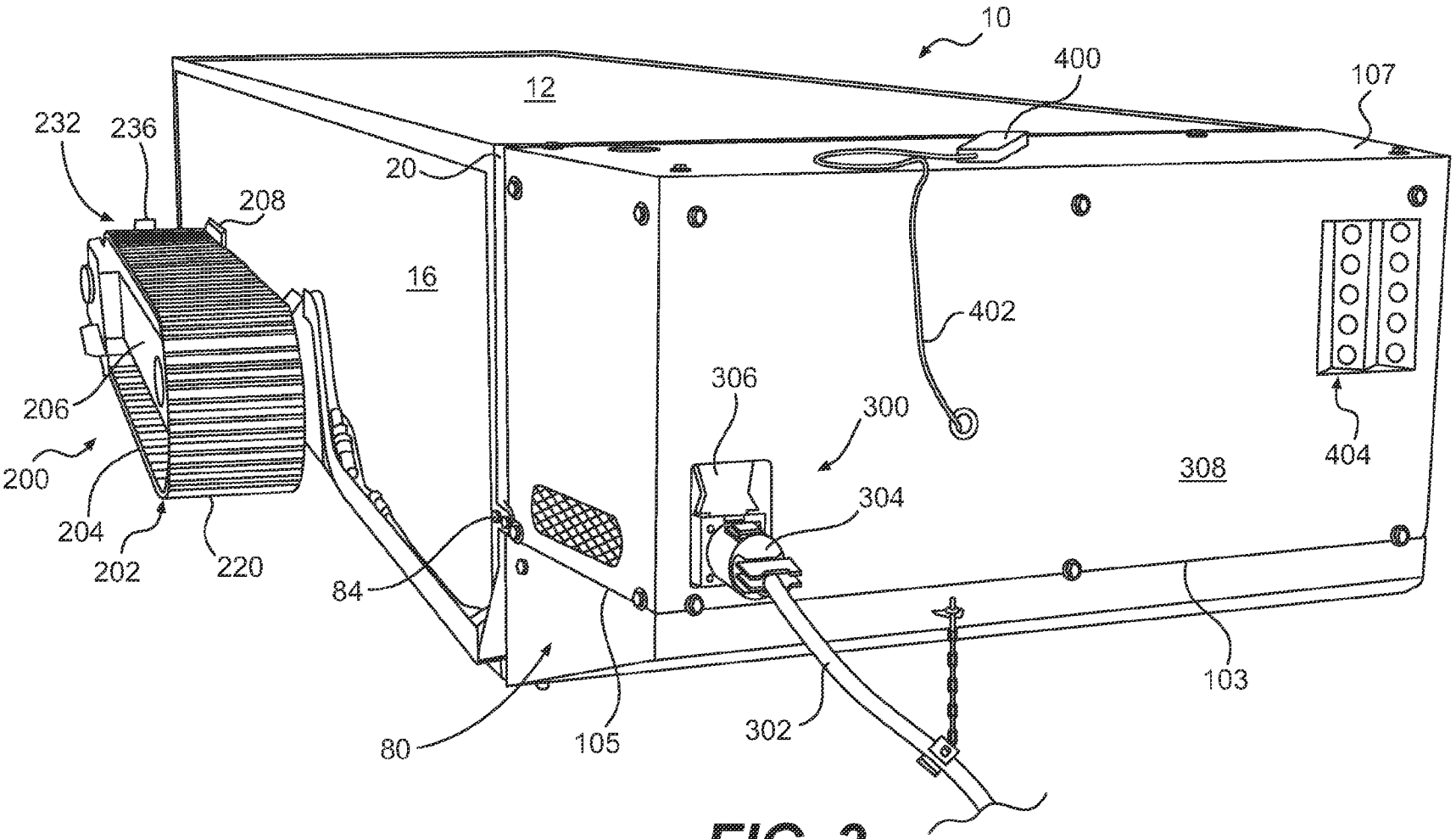
FIG. 3 is a rearward perspective view thereof.

To gain a better understanding of the invention, a preferred embodiment will now be described in detail. Frequent reference will be made to the drawings. Reference numerals or letters will be used throughout to indicate certain parts or locations in the drawings. The same reference numerals or letters will be used to indicate the same parts and locations throughout the drawings, unless otherwise indicated.

B. Environment

The preferred embodiment for the mobile refuge chamber includes a track assembly on each side of the chamber structure providing an on board drive assembly and thereby the ability to move the mobile refuge chamber within a mine environment and through roadways, tunnels, and crosscuts, and even through passageways that have low overhead clearances. The scale of the embodiment, therefore, is to be understood with respect to this type of device. It is to be understood as well, however, that the invention is not limited to one size refuge chamber, but on the contrary it is applicable to a variety of other sized refuge chambers and its scale can vary accordingly.

The mining of coal, other ores or materials in underground areas is frequently associated with hazardous environmental conditions that exposes miners to roof collapses, explosions, toxic gases, dust, carbon monoxide and carbon dioxide, to name but a few. Consequently, it imperative to provide some form of emergency shelter and protection for miners during their work, and especially for those miners working close to the working face. Preferably such a shelter should be repositionable easily and quickly in order to remain relatively close to the mine face as possible, as the mine face will be advancing and the shelter will need to be repositioned at least every few days or more frequently than that depending upon the speed at which the mine face is advancing. This keeps the shelter immediately available in the event of an accident or the onset of some hazardous event.

The present invention as described herein comprises such a temporary shelter for about 96 hours, and is made from materials that will provide the desired shelter and employs a drive system that makes the shelter a mobile refuge chamber that is easily movable within the mine environment and without any external assistance such as shovels, tractors or scoops present in the mine for other purposes.

The most common shelters or refuge chambers are conventionally provided with skids or only a set of tires that permits them to be lifted, pulled or pushed around a mine by miners, by a towing machine or by some other separate equipment that can push or pull the shelter into a desired position. Where such shelters are long or big structures they must be frequently man-handled or "rough housed" to get them to turn corners or to physically maneuver them from one place to another within the confines of the mine roadways. Such rough housing cannot only damage the structure of the chamber itself, but can damage equipment or supplies stored or contained therein. It can also ruin sensor equipment provided on or within the shelter for sensing the atmosphere inside or around the chamber, gas monitoring equipment, flow meters, regulators, communication equipment, piping within the chamber, or other parts of the chamber. Further, if such sensor equipment is not ruined it may be moved with sufficient force that the normal calibration will be adversely effected which can thereby render such equipment inoperable for their intended functions. By employing such a drive system the present refuse chamber can be made from stronger, thicker materials, with a denser structural integrity, higher yield structured and recovering plates, additional amounts of oxygen cylinders, additional water and other supplies, as total weight of the chamber and the various items and supplies provided internally within the refuge chamber are not an issue with the mobility features.

The present mobile refuge chamber disclosed herein differs in that it is itself mobile and includes a drive mechanism or mobility system that will transport the entire refuge chamber directly into and out of a mine as well as within a mine and along mine tunnels, roadways or crosscut networks of passageways normally associated with and found in an underground mine environments, without the need for any separate drive or movement devices.

C. Structure

FIGS. 1-4 show a refuge chamber 10 formed with a strong and reinforced exterior comprised of, for example, a roof 12, left and right sides 14 and 16 when looking rearwardly along the chamber 10 from the front end wall 18, respectively, a rear end wall 20, and a bottom wall 22. Preferably the exterior skin will be formed from metal panels or sheeting, for example, steel, aluminum or mine environment approved composite materials, welded or otherwise interconnected and attached to an underlying support structure to form a pressure and vacuum proof interior. Each of these exterior wall panels or sheets can be attached to an internal or underlying support structure formed from interconnected beams or cross beams, for example those shown for the top at 30, 32, 34 and 36, as shown in FIG. 5, and for the sides diagonally extending beams or supports 40, 42 and 44, as shown in FIG. 9, extend between and can be connected to horizontal fore-to aft-beams 46 and 48. Similar supports will b provided in the bottom wall 22. Collectively these corner, diagonal, side bottom and internal supports will be interconnected in a pattern, for example, as shown in FIGS. 5-9, and will provide an inner skeleton that will support and reinforce the exterior skin.

These support tubes can have a variety of dimensions, and typically then can be, for example, 3×3×⅛ or 3×3×¼ to 2.5×2.5×3/16.

As noted above, the external skin can be formed from, for example, steel plating that can preferably have a thickness that can vary from ⅛$^{th}$ at a minimum, to about ¼ inches thick. However, it should be understood that other metals, such as aluminum, or other materials, such as polycarbonates or composite materials such as reinforced plastics, or combinations of these could be used with or co-molded with metal or other materials, could also be used. Also, while a range of thicknesses has been proposed, other plate thicknesses could be used depending upon a particular mine environment that is to be using a particular shelter which might need to be made with a stronger or more impact resistant exterior. It is preferred that the corners be further reinforced by using a welded over lay comprised of a right angled steel edge cap 50 as is shown in FIG. 9, at the upper right corner, for example, but any desired reinforcing can be used.

Front end wall 18 includes a sealable marine grade door structure 60 that can include, for example, a marine type hatch 62, manufactured from cast aluminum or other strong material, that is attached by hinges 64 and 66 closing on opening 68 that is also shielded by a raised exterior wall 70. The door 60 will further include an integral exterior handle 72 and suitable latching and seals, not shown, that will render the door 60 airtight so as to maintain a positive pressure there within the chamber located adjacent the intern of door 60. This will be more fully discussed below in connection with the air lock used upon entry into chamber 10 in an emergency situation. Door 60 can operated either manually or hydraulically with the opening and closing being possible from both outside and then inside. Front wall 18 also includes a sight port 52 that is provided with a cover plate 54 that can be secured in place when the chamber 10 is not being used. Prior to entering chamber FIG. 10 miners can open cover 54 thus exposing a glass window 56 through which miners in chamber 10 can see out and by which those outside chamber 10 can see into chamber 10.

Rear wall 20 supports a separate power module 80, with power module 80 being removably connected thereto by a latch structure 82 that can extend across the top of rear wall 20, be engaged by the top portion 81 of the power module 80, and by suitable bolted interconnections 84 provided at the sides.

As shown in FIG. 5, for example, the refuge chamber 10 preferably has two interior compartments, a front one shown at 90 and a main compartment shown at 100. In between is an interior bulkhead wall 110 that is provided with another air lock door 112 with door 112 being, for example like door 60, and being closed or opened from either compartment 90 or 100.

The front compartment 90 comprises an air lock chamber that is accessed from the outside via door 60 and from the main chamber 100 via an interior door 112. Front chamber 90 is large enough to permit five miners to enter at one time. Once those five miners are housed in chamber 90 door 60 is closed, either from the inside or outside, and a purge system 92 will be activated and used to purge the mine's atmosphere from within the front air lock chamber 90, thereby preventing that atmosphere from affecting the main chamber's atmosphere as the interior door 112 will also be closed and sealed. Once the miners are in chamber 90 and door 60 is closed and secure, a purge switch 94 is actuated that releases compressed air from purge air tanks 96 into chamber 90 via suitable tubes 98. Miners will release the purge air for approximately 5 to 7 minutes while also taking readings from hand held gas monitors, which can be provided within chamber 90. After the volume of chamber 90 has been raised about 3 times, or to a pressure of about 0.6 to 1.2 psi, and preferably about 0.8 psi, and when the atmosphere within chamber 90 has reached a safe level, air within chamber 90 is purged from chamber 90 to the exterior of refuge chamber 10 via a relief port 102. Once the purge and cylinder is completed, the miners within chamber 90 will open the interior bulkhead door 112 and enter the main chamber 100. Once the interior bulkhead door 112 is then re-closed, the next set of five miners can open door 60 from outside chamber 10 and enter chamber 90. Once door 60 is again closed the process for purging the mine atmosphere from within chamber 90 can then be repeated with that next set of miners. If there are fifteen miners total this air purging process will be repeated three times until all fifteen miners are housed within the main chamber 100.

Relief port 102 can have two valves that can control the pressure level within the above noted limits, and to prevent either chamber 90 or 100 from being over pressured. The test port 102 allow miners to hook up a gas monitor to a valve internally mounted within purge chamber 90 and using flexible tubing miners can hook up to the relief port and with the valve opened they can then check or monitor gases or the environment exterior to the chamber 10.

The interior dimensions for the front air lock chamber 90 can be, for example, about six feet in length, with a height of about four and a half feet, and a width of about seven feet eight inches. The main interior chamber 100 can have an internal length of about twenty-two feet and hung the same height and width as air lock chamber 90. The external dimensions for the whole refuge chamber 10 will be about twenty eight feet and hung inches in overall length, about eight feet in width, and about four feet seven inches in height. The unit is also offered in a 30" inch height up to a 55" inch which is also provided with same mobility features.

Main compartment 100 is shown in FIGS. 5-9 and includes an oxygen system 120, a $CO^2$ extraction or discharge system 130, a sewage or waste system that discharges to the exterior 140, an interior wall/ceiling system 150, and an electrical/communications system 160 in a box located on a side wall inside chamber 90.

Figure 6:
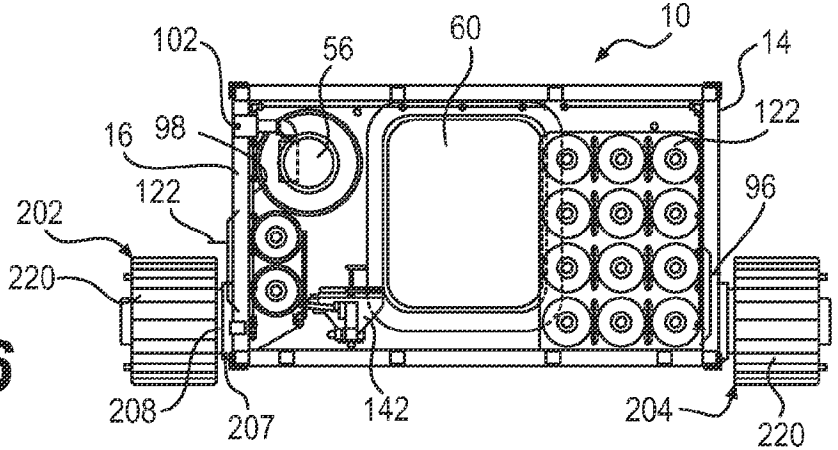
FIG. 6 is a cross sectional view taken along line 6-6 in FIG. 5.

The oxygen or $O^2$ system starts with a plurality of oxygen tanks 122 that can be stored within chamber 90 as shown in FIG. 6, and through a suitable controller 124 and manifold 126 the flow of oxygen can be sent through a series of discharge tubes 128 into the main chamber 100.

Figure 7:
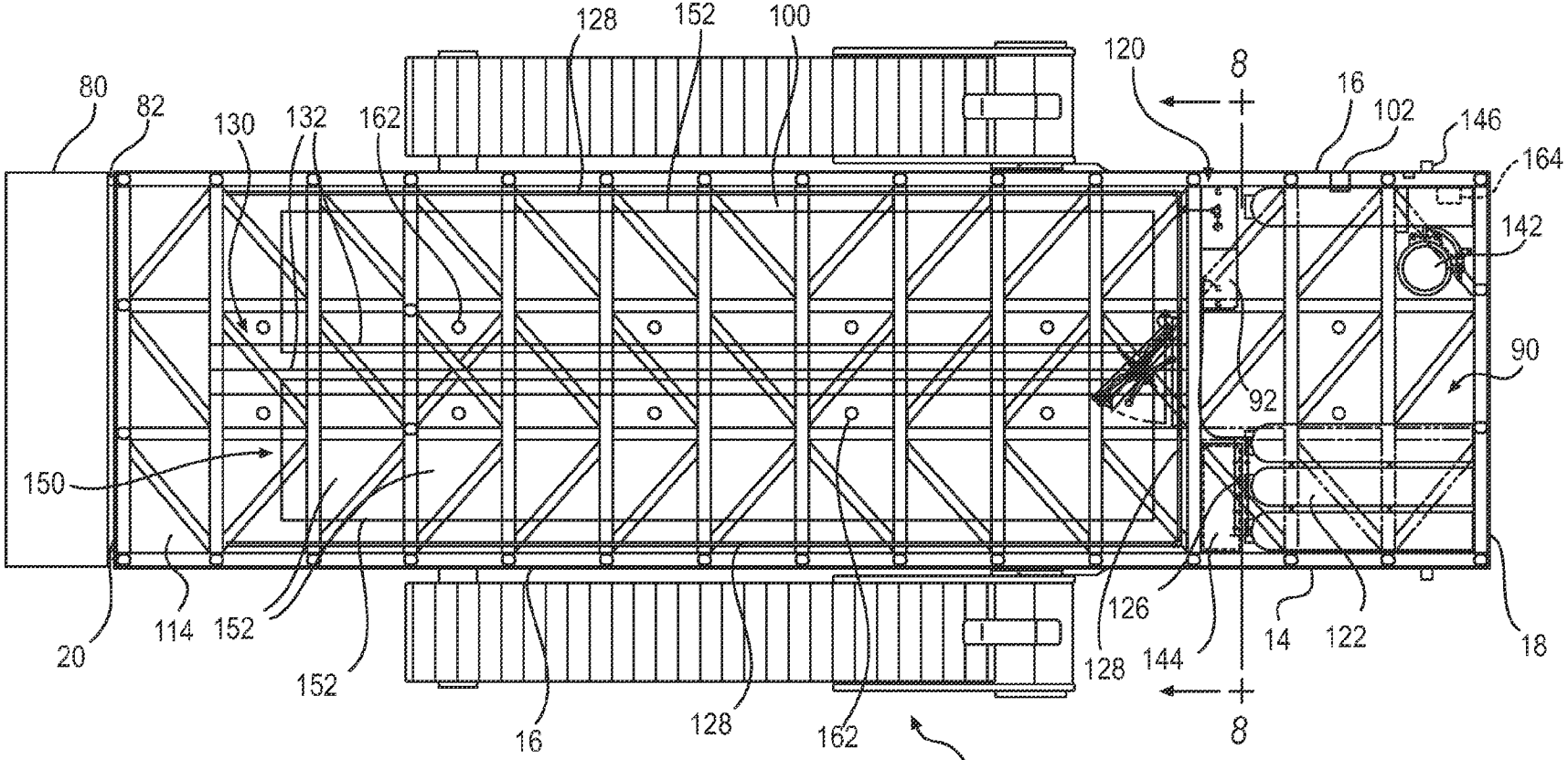
FIG. 7 is a top plan view with the outer surface having been removed to show the oxygen air system.

The $CO^2$ extraction or discharge system 130 is comprised of a series of carbon-dioxide absorbing screens or curtains (not shown) that can be stored in the seats provided in the main chamber 100 or in storage areas beneath removable flooring panels 114 and once removed for use can be unfolded and hung from hanger rods 132 that are supported from the ceiling of the main chamber 100 so as to run along a major portion of the axial length of that chamber, as shown in FIGS. 5 and 7. One example of such CO2 absorbing fabric can be found in U.S. Pat. No. 6,699,309, which is incorporated herein by reference. The curtain or sheet can be, for example, a Lithium Hydroxide curtain that acts as a passive $CO_2$ absorbent structure that provides rapid $CO_2$ reduction in enclosed areas, especially for the amount of time miners would be expected to remain within the chamber. When hung up with all sides exposed, such curtains can effectively absorb carbon dioxide out of the air such as that being expelled by the miners housed within the main compartment or chamber 100. Such absorbing curtains do not require electric power to operate, but rather only need to be hung from rods 132 with all sides exposed so the soda lime chemicals can react with the $CO_2$ gases and remove them.

Figure 8:
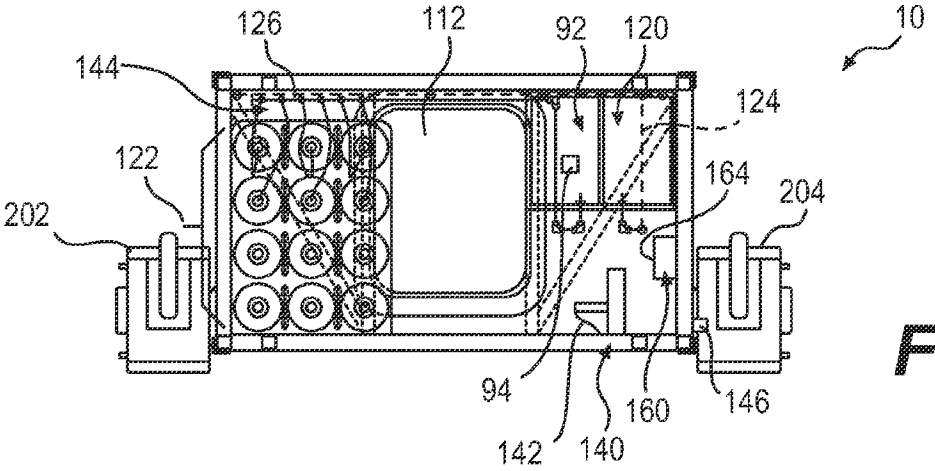
FIG. 8 is a cross sectional view taken along line 8-8 on FIG. 7.
Figure 9:
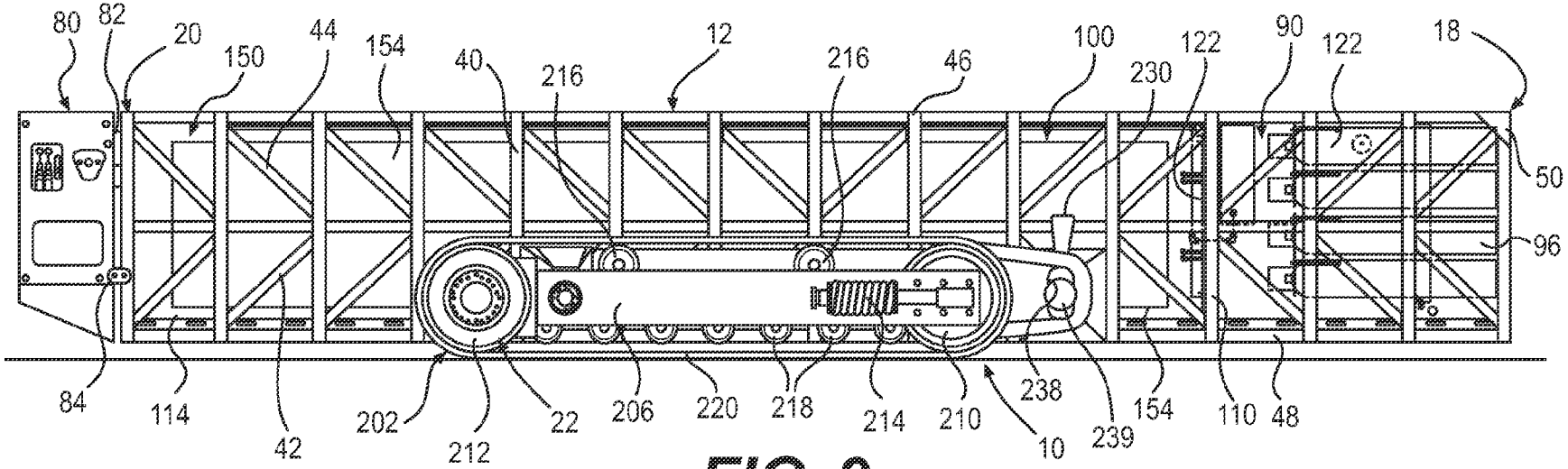
FIG. 9 is a side of the refuge chamber with the outer structure removed.

The sewage or waste system 140 includes a toilet 142, a supply of water in a tank 144 to operate toilet 142, and a discharge outlet 146 to discharge waste outside of refuge chamber 10 as shown in FIG. 8.

The interior wall/ceiling system 150 can be comprised of a series of ceiling panels 152 and wall panels 154 that can be rolled or folded up and then installed once miners are inside chamber 100. Alternatively, panels 152 and 154 could be permanently installed inside chamber 100 and will preferably, regardless of which form they take, will be white to thereby reflect light within chamber 100.

Provided by a plurality of hung flash lights 162, the electrical/communications system 160 will include the plurality of interior lights 162, preferably in the form of MSHA approved intrinsically safe flash lights that can be suspended from the ceiling, as well as suitable controls for various sensors, air pressure controls, oxygen controls and the communications equipment. There is also a communication phone 164 provided in chamber 10. The main chamber 100 can also be provided with bench style seating extending along the length of the main compartment 100 that can include as well suitable amounts of built-in storage areas therein to provide space, for example, for medical supplies, food, drinking water, bedding, extra light bulbs, flash lights, MSHA approved batteries, and other emergency supplies.

Figure 13:
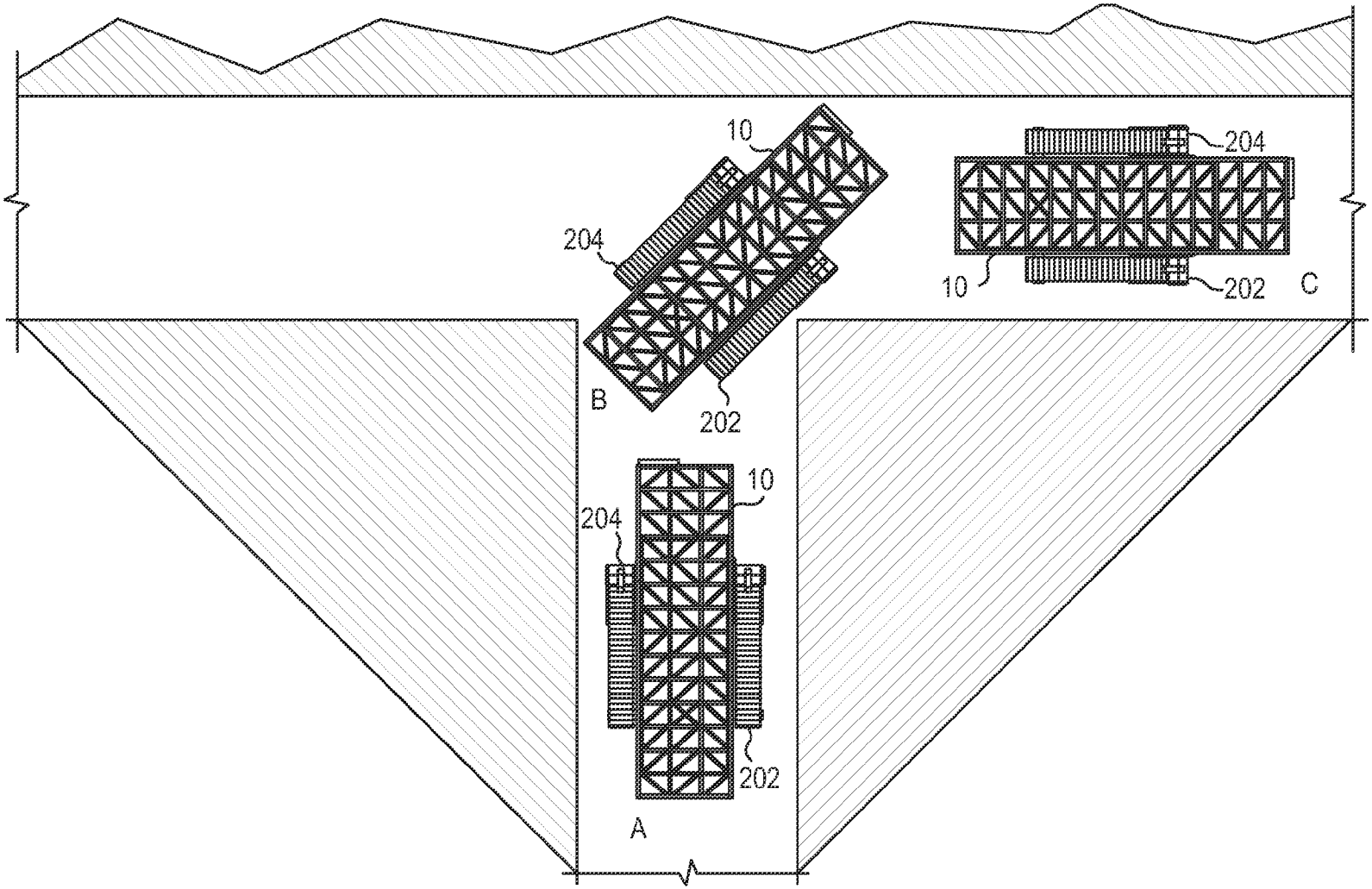
FIG. 13 is a top diagrammatic view of a mobile refuge chamber moving within a mine environment.

As is demonstrated in FIG. 13, it is necessary that a mobile refuge chamber 10 be moved along and through roadways and cuts within the mine. The chamber 10 is shown, for example, moving form a position A, then through a position B that entails maneuvering around a corner, and then to a position C. In order to provide the moving ability for refuge chamber 10 a motive system 200 is provided in the form of, for example, a pair of hydraulic powered, crawler side frames with integral drive system or tractor assemblies 202 and 204 manufactured by Intertractor America Corp., in Elkhorn Wis., universal side frame models, for example, model number UQ946A00N00003/4 or UQ901A00N00101/102. It is preferable the mounting for tractor assemblies 202/204 include fluid ride mounts to minimize vibration as chamber 10 is moved.

Each tractor assembly will include a central track frame 206 that extends along the interior length of the track assemblies 202/204, and will be mounted to a bottom central portion of each side of chamber 10 by way of, for example, a mounting assembly 208. This mounting assembly 208 can be bolted or otherwise securely secured to welled trunions 207, shown on FIGS. 6 and 8, with trunions 207 being in turn welded or otherwise secured to the internal support structure of chamber 10, for example to the appropriate diagonal and horizontal beam 40-48.

Track frame 206, as used on each of the track assemblies 202/204 will support a spring tensioned, front idler 210, a tensioning spring 214, a rear drive sprocket 212, one or more optional top idlers 216, a plurality of bottom track rollers 218 all of which support and drive an outer track 220. Not shown is a suitable brake assembly to hold tracks 220 in a fixed position, with the hydraulic circuit showing brake releases at 282 and 284.

Figure 14:
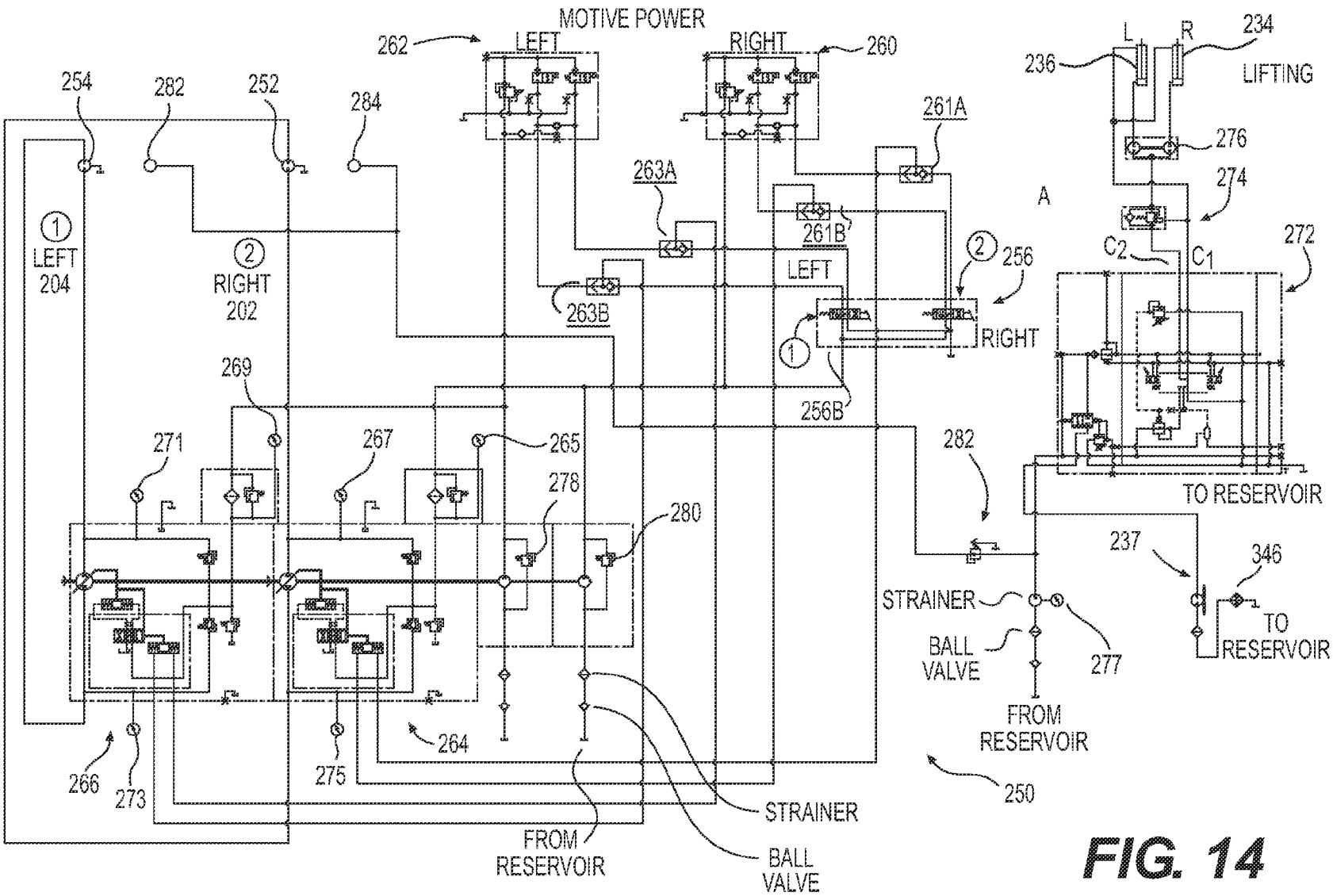
FIG. 14 is circuit diagram of the power module hydraulic system.
Figure 15:
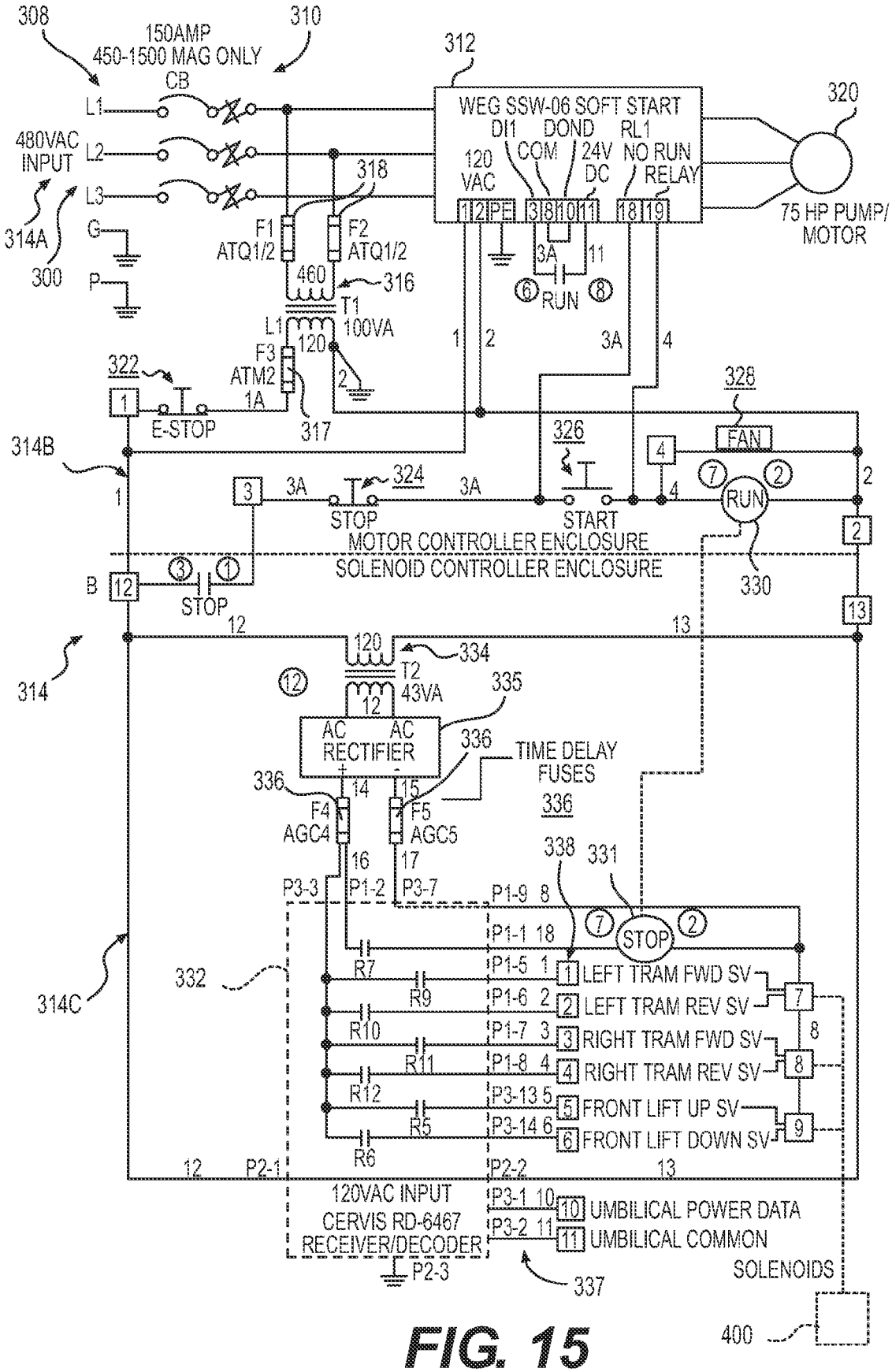
FIG. 15 is a electric circuit schematic for the controller.
Figure 16:
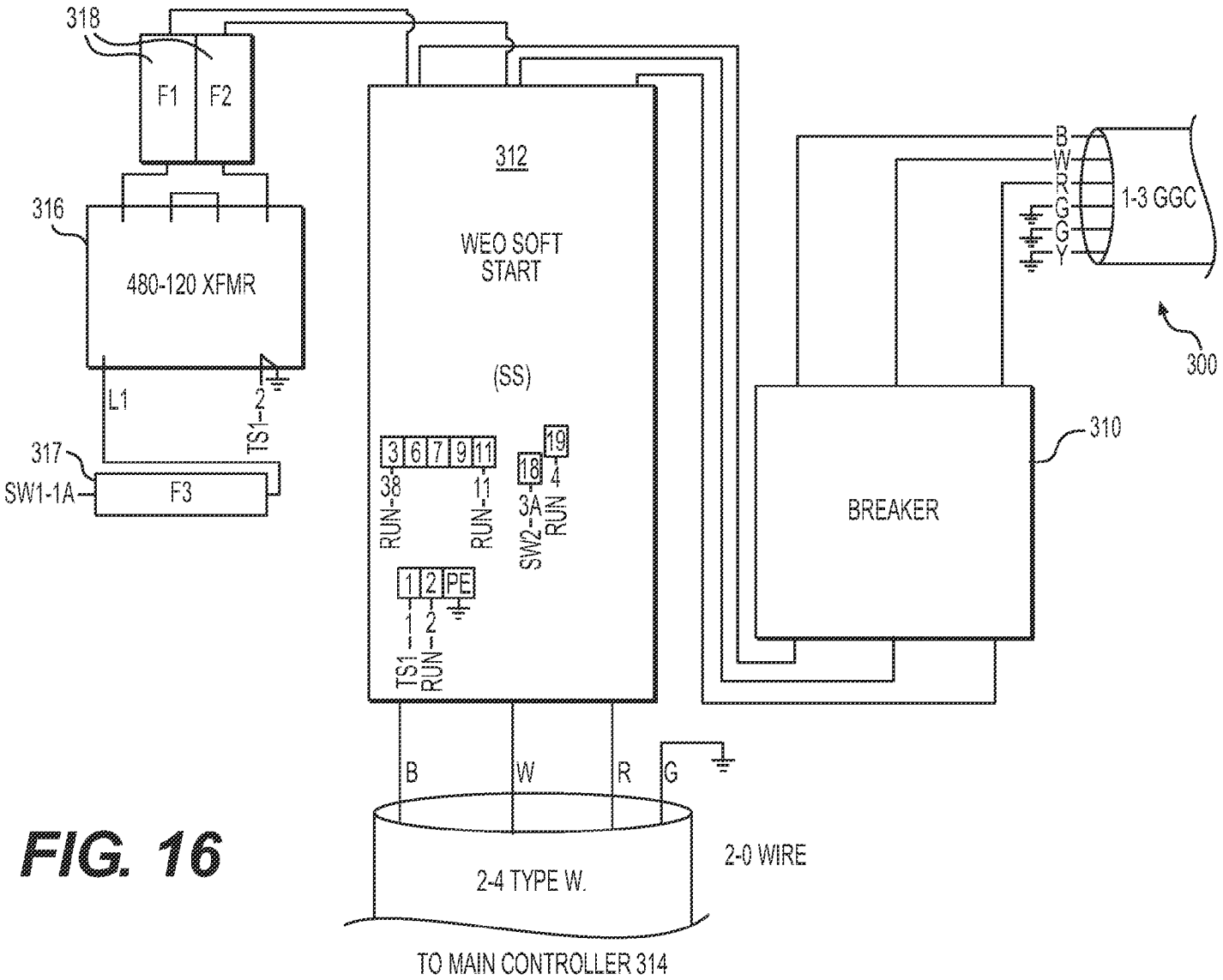
FIG. 16 is a wiring diagram for the controller.
Figure 17:
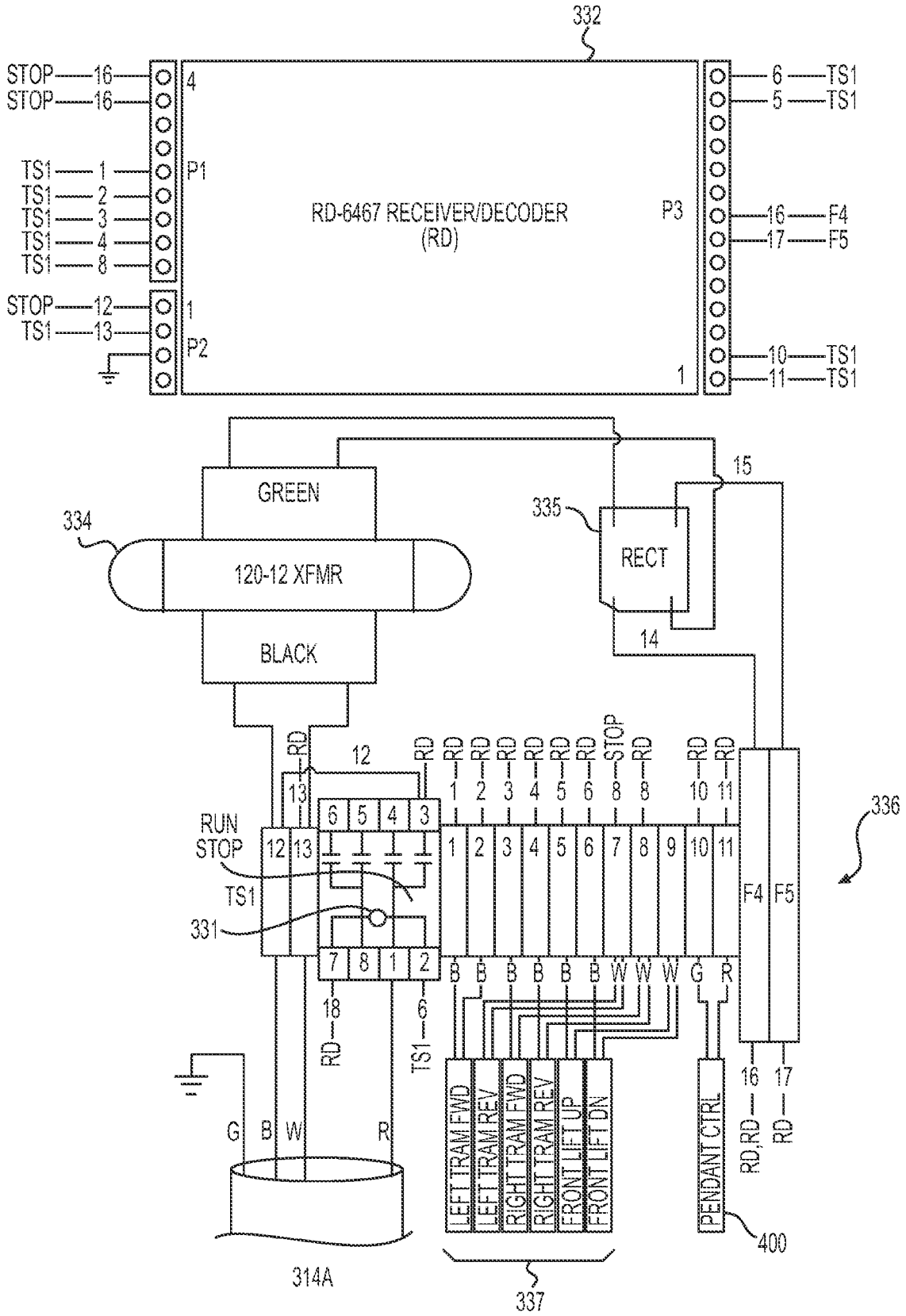
FIG. 17 is a continuation of the controller wiring diagram.

Each of the tractor assemblies 202/204 will be powered, for example, by hydraulic drive motors 252 and 254, respectively, as shown on FIG. 14 that shows the entire hydraulic circuit 250. Hydraulic motors 252/254 will be powered by a 45 to 75 horse power electric motor 320, shown on FIGS. 4B and 15, that is an explosion proof for cooled 480 volts, 3-phase motor, for example a WEG mode 107518XP3E365TC or equal quality and capability motor. Motor 320 will be connected to and powered by an approved, mine power source as will be further explained below in connection with the power controller and electrical system as shown in FIGS. 15-17. It should be understood, however, that any other MSHA approved power system could also be used.

Figure 4:
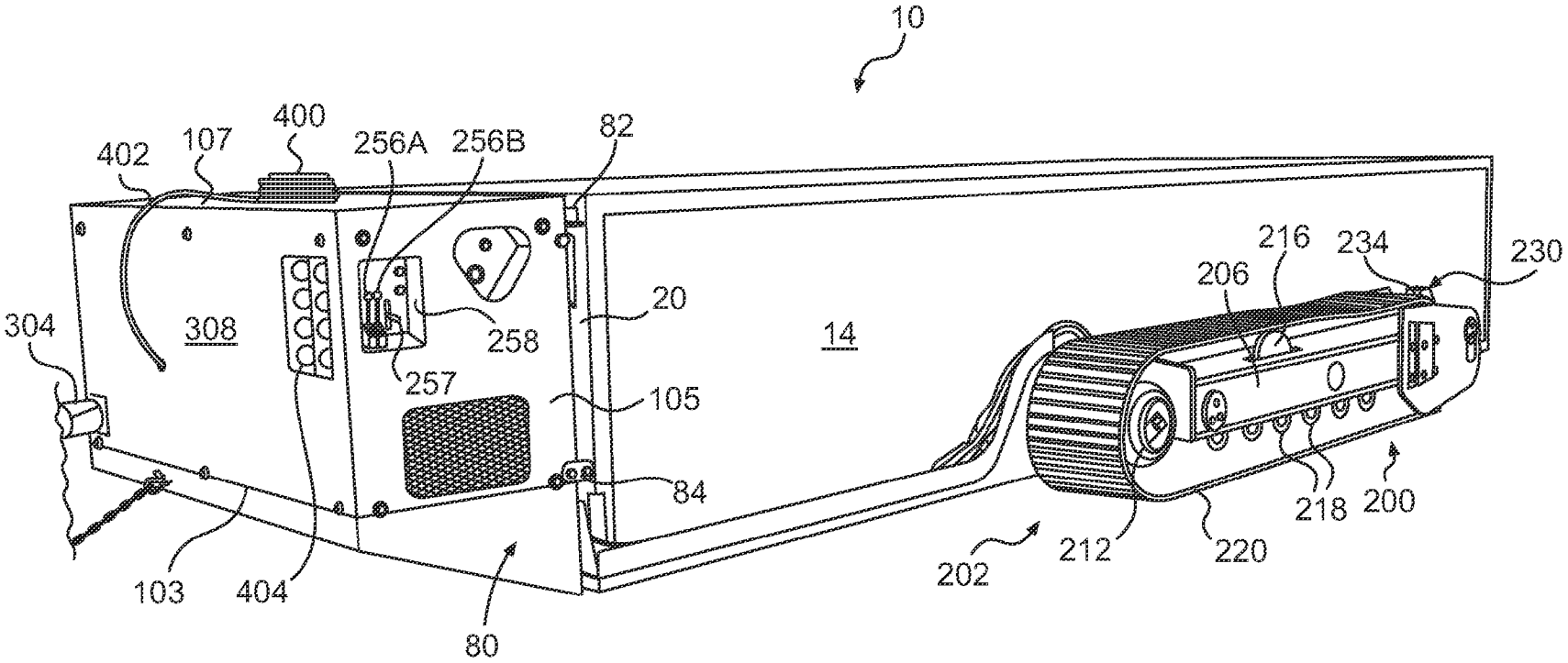
FIG. 4 shows the rear end of the refuge chamber.
Figure 4A:
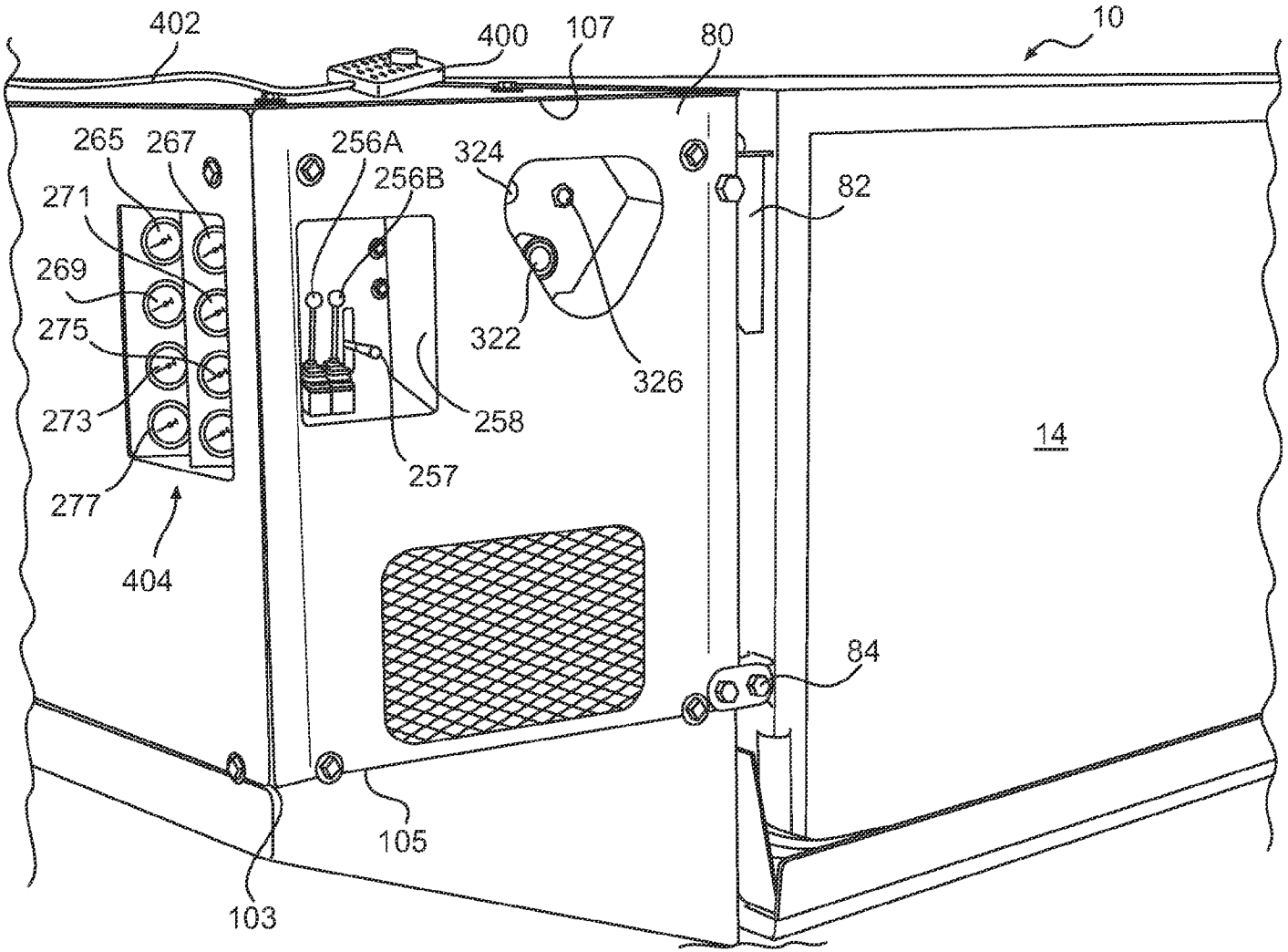
FIG. 4A is a partial side view showing the rear of the chamber and a side of the power module.
Figure 5:
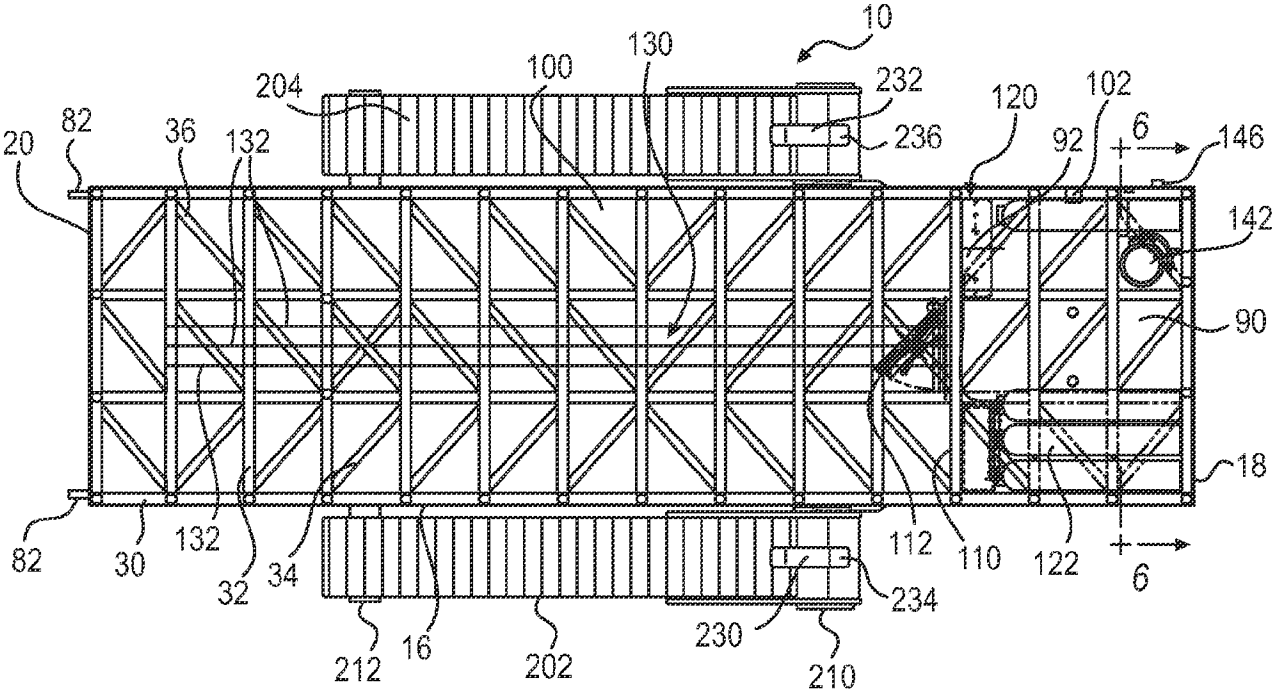
FIG. 5 is a top plan view with the outer surface having been removed to show the purge air system and internal structures including compartments, doorways and storage areas.
Figure 10:
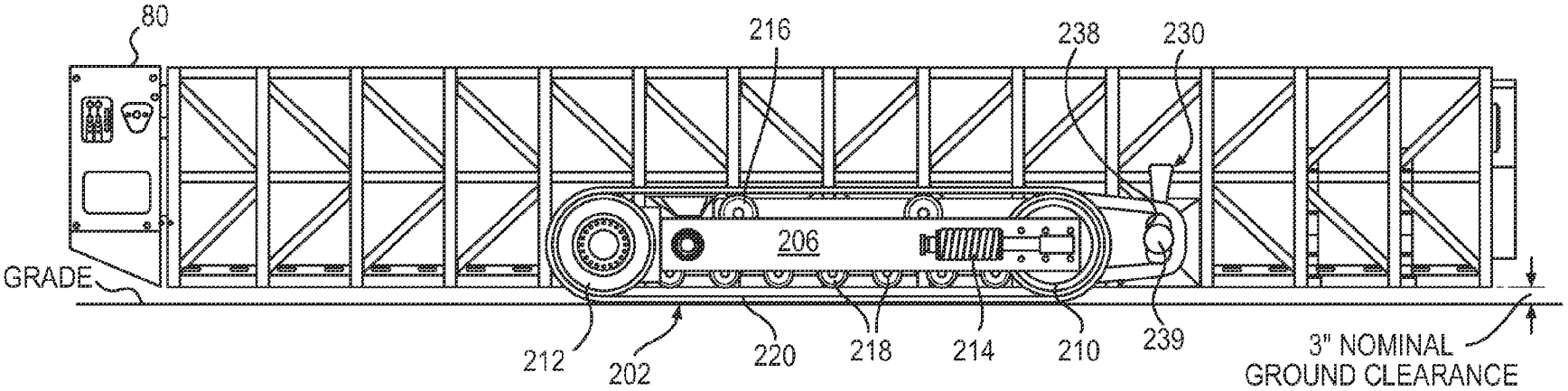
FIG. 10 is a side elevational view showing the refuge chamber in a normal, level position.
Figure 11:
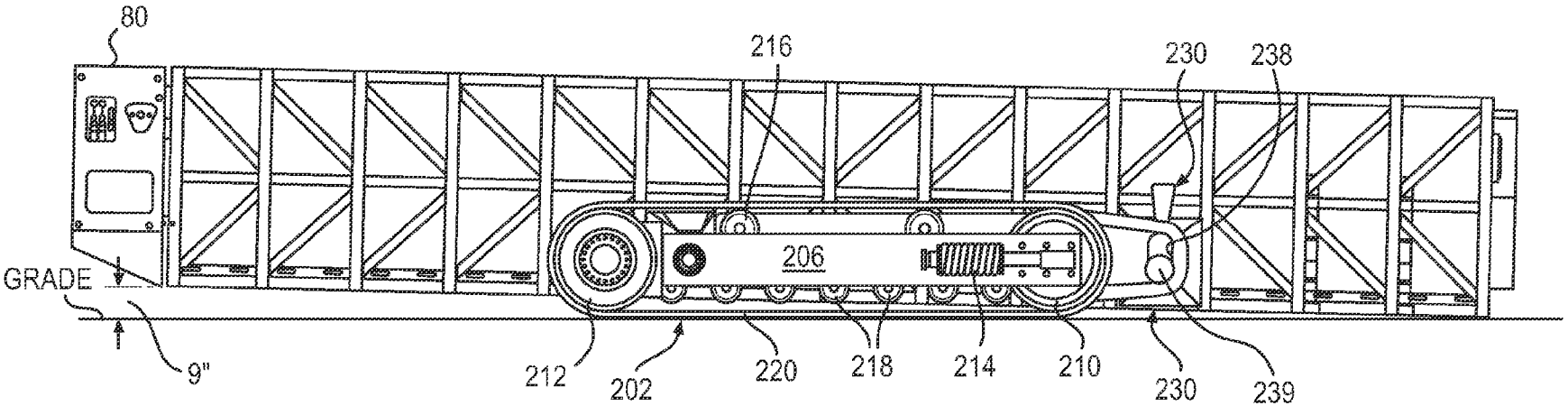
FIG. 11 is a side elevational view showing the refuge chamber when oscillated toward the front of the refuge chamber.
Figure 12:
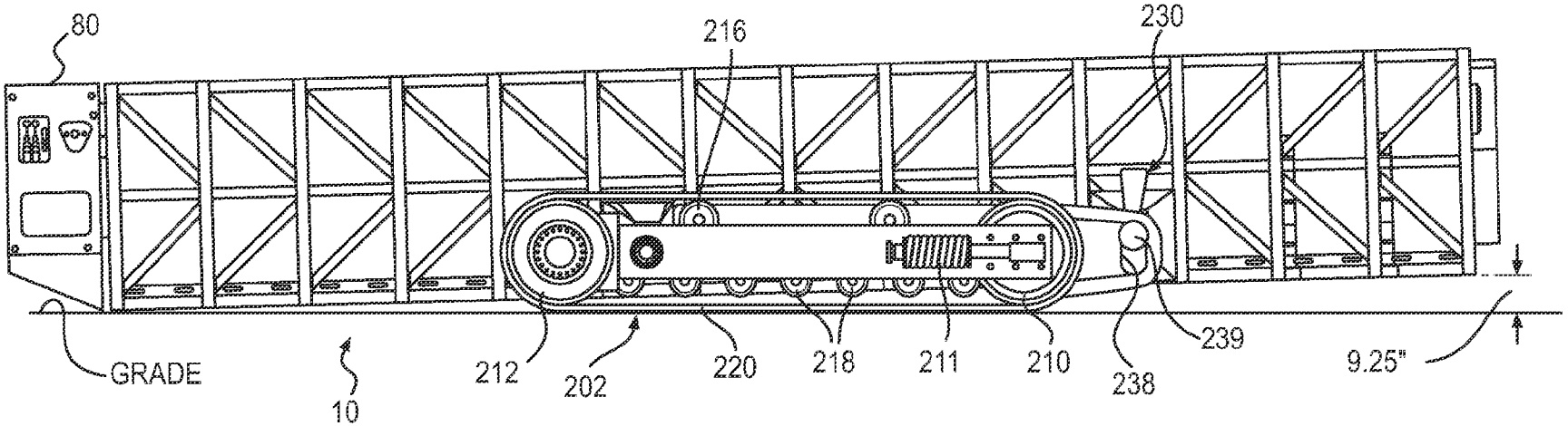
FIG. 12 is a side elevational view showing the refuge chamber when oscillated toward the rear of the refuge chamber.

Each of the tractor assemblies 202/204 is also provided with its own tilt control system 230 and 232, respectively, that is preferably mounted adjacent one end thereof, for example the front end as shown in FIGS. 1 and 9-12 and operated by a lever 257, for example as shown in FIGS. 4 and 4A and located within a recess 258 provided in the side of the power module 80. Each of these tilt control systems 230/232 includes a double acting, hydraulic cylinder 234 and 236, respectively, which is preferably mounted between the tractor assemblies 202/204, and specifically the frame 206, or the mounting assembly 208, and the trunions 207 that are mounted directly to the internal frame of the chamber 10. Between those two points of attachment the hydraulic cylinders 234/236 can have a range of motion of about 10" inches. Chamber 10 will be supported by the tractor assemblies 202/204 so that the bottom of the chamber will be in a level condition relative to the mine floor and have a normal, nominal clearance of about 3 inches between the bottom and the mine floor or the supporting surface. This level condition is shown in FIG. 10. It can be noted that a pin 239 is contained within a slot 238 in the track assembly 202, and when in this level condition pin 239 will be positioned about mid-way along slot 238. By use of the tilt control systems 230/232 on each side of chamber 10, the whole chamber 10 can be tilted so that either the front of the rear portion of chamber 10 can be made to almost touch the mine floor, which will provide coordinated rise at the opposite end of the chamber 10 that can vary from about 8 inches to about 9.5 inches, and preferably about 9 inches. FIG. 11 shows the rear end portion being raised, with pin 239 now at the bottom of slot 238, while FIG. 12 shows the front end portion being raised with pin 239 at the top of slot 238. Cylinders 234/236 are preferably hydraulic cylinders driven by the same hydraulic system, as described more fully below. However, they could also be powered by another approved MSHA approved power source.

Figure 4C:
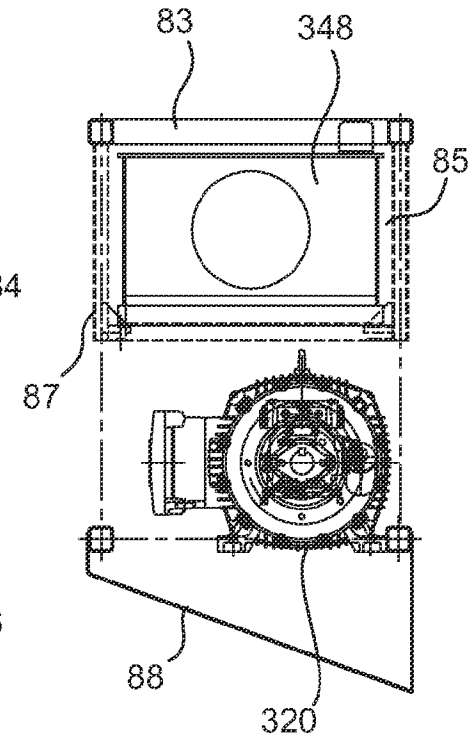
FIG. 4C is a view of details of the power module
Figure 4B:
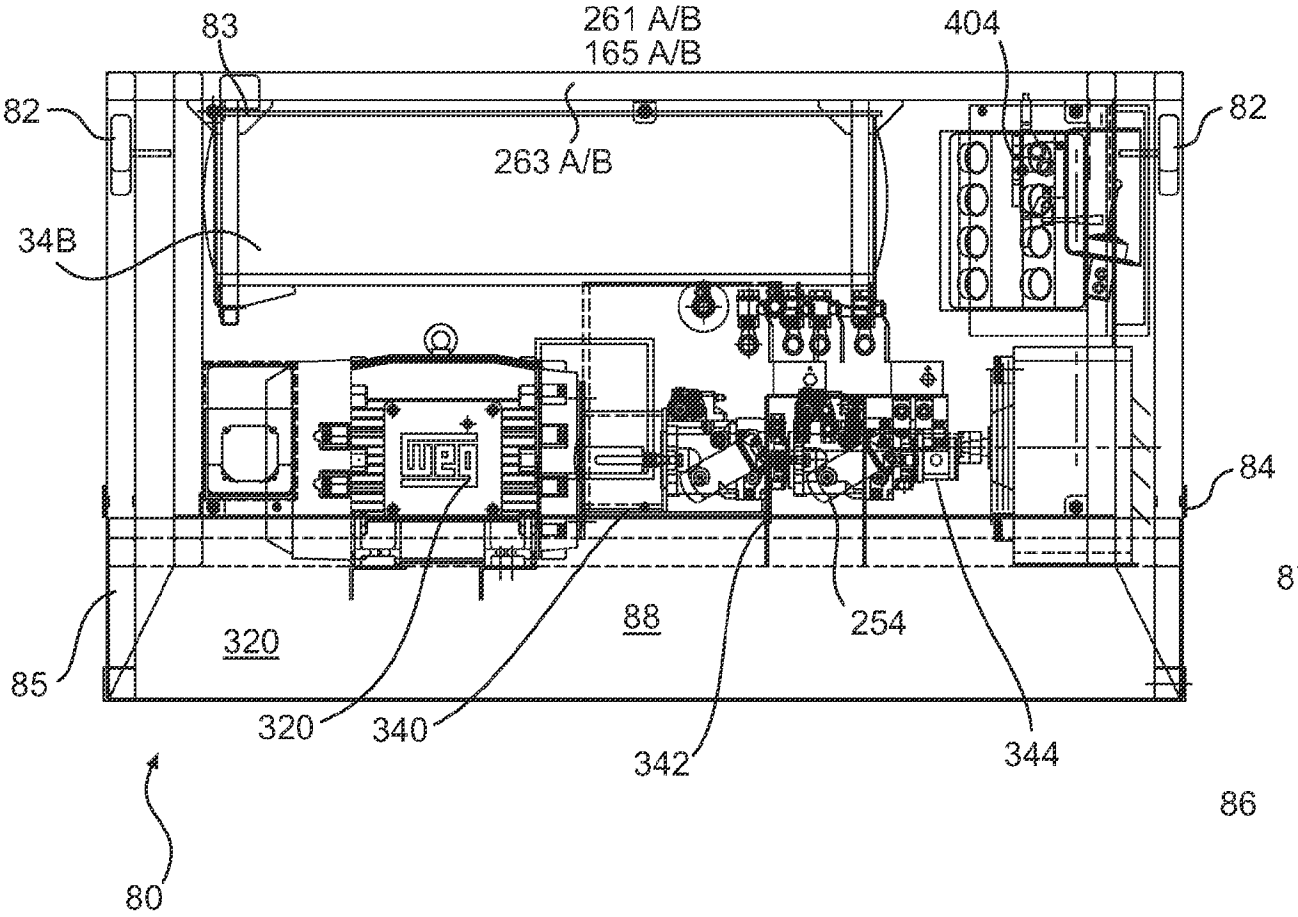
FIG. 4B is an elevational view looking into the power module.

Details of the power module 80 are shown in FIGS. 4B and 4C and include a top frame 83, a front frame 85, and a rear from 87, with a bottom section 88. As shown in FIGS. 4 and 4A the power module 80 has an outer skin provided by a rear panel 103, side panels 105 and a top panel 107.

The hydraulic system is shown in FIG. 14 and the two main hydraulic motors 252 and 254 for the tractor assemblies 202/204, respectively, are shown in the upper left of the figure. Each motor is controlled by direction inputs that can be provided by either a joy stick controller, 256A and 256B, that can be seen as well in FIG. 4 located within a recess 258 at the upper rear of panel 105, or from a separate pendent controller 400. By either of these signal input devices, signals can be initiated to control the movement of chamber 10 and the forward or rearward movement of tracks 202/204. In each case, an operator will stand outside of chamber 10 and can use the joy sticks or the pendent controller 400 to direct and thereby control the forward and rearward movement of chamber 10.

The joy stick controllers 256A/B, or the inputs from pendent controller 400, will each control one track, for example joy stick 256A can control the operation of motor 252 for tractor assembly 202, and joy stick 256B can control motor 254 for tractor assembly 204. Each joy stick controller 256 A/B, or alternatively if using the pendent control then inputs from the pendent controller 400, operates pump control valves 260 and 262, respectively, through two pairs of shuttle valves, 261A and 261B and 263A and 2643B, respectively, which in turn connect through first and second charge pumps 278 and 280, and then to control motors 252/254 through pump circuits 264 and 266, respectively.

As can be noted on FIG. 14 pump circuits 264 and 266 include a series of pressure gauges primary drive system 265, tilt control system 267, left track drive forward 269, right track drive forward 271, left track drive reverse 273 and right track drive reverse 275, respectively, and these are also shown grouped together on a control gauge panel 404 at the rear of the power module 80 as in FIG. 4A. An additional pressure gauge 277 is provided to monitor charge pressure left primary pump and 278 is charge pressure on right primary pump systems.

On the right side of FIG. 15 are the two double acting, lift cylinders 234 and 236 in the front of the tracks and two double acting in the rear that will be powered by a hydraulic motor 237 that is connected to cylinders 234/236 by a pump control valve 272, a counter balance, or holding, valve 274 and a flow divider 276 to assure that cylinders 234/236 operate in unison. The control of lift cylinders 234/236 will be provided by way of a separate control lever 257 that will actuate one of two solenoids No. 5 or 6 in the electrical controls for solenoids 337, shown in FIG. 15, to control the pump valve 272 and thereby operate cylinders 234/236 in one of an up or down direction. Brake releases 282 and 284 will be connected to the lift cylinder control circuit via a pressure reducing valve 286 so that lift cylinders 234/236 will only operate when the brakes are released.

As mentioned above, electrical system is set forth in FIGS. 15-17 with FIG. 15 showing the electric schematic for the controller and FIGS. 16 and 17 showing the wiring diagrams for the controller components shown in the electrical schematic of FIG. 15.

FIG. 15 shows a main controller at 314, which includes a power input section 314A, a motor controller section 314B, and a solenoid section 314C, all of which are provided within power module 80. A 3-phase power connection of power input section 314A of the main controller 314 is generally shown at 300 that includes a 480 VAC input. This input power supply 300 can be supplied directly from the main source of power in a mine, for example, via a power cable 302 and a suitable plug 304 that plugs into a connection terminal 306 provided on the rear wall 308 of the power supply module 80 that can be attached to the rear of chamber 10 as shown. Alternatively, this main 480 VAC, 3-phase power supply can be provided from a secondary source such as a rock drill with similar power requirements.

Looking first at the motor controller section 314A, the power connection 300 includes a circuit breaker 310 in the form of a 150 amp fuse and power is thereafter directed to a main pump and motor 320 via a soft start controller 312, such as, for example, a WEG SSW-06 Series, Soft start device. Such soft-starters are static starters intended to accelerate, decelerate and protection of three phase induction motors. The control of the voltage applied to the motor by the means of the thyristors triggering angle variation, allows the soft-start to start and stop smoothly an electric motor, as is being done here for main pump/motor 320.

The three phase power input for motor controller section 314A is also connected to a first transformer 316 via fuses 318 and then to a series of control buttons 322, 324 and 326. A fan 328 is controlled by a run/stop solenoid 330/331 with fan 328 being located within the power module 80 to provide cooling to the main pump/motor 320. The run/stop solenoid 330/331 has its control connections shown as coming from pin connections 7 and 2 of a receiver/decoder 332, with the run side being shown within the motor controller section 314B, and the stop connection being shown in the solenoid controller section 314C.

Transformer 316 steps the voltage down from 480 VAC to 120 VAC and a second transformer 334 steps the voltage down from 120 VAC to a low voltage system using 12 volts. The intervening control buttons, previously noted, provide an emergency stop command via button 322, a start command via button 326 and a stop command via button 324.

Main controller solenoid control section 314C is set up to permit various movement control inputs. One source of such control inputs can occur via a connection to a set of joy stick controllers 256 A/B, whose input signals are provided via a receiver/decoder device 332, such as a Cervis, CST/RD-6467, that is powered by its connection within controller section 314C to the second transformer 334, a rectifier 335 and time delay fuses 336. Joy stick inputs are provided at pin connections 1-6 via a series of solenoids 338. In addition, or as an alternative source of control inputs, control over the chamber's movement can also be provided via a pendent type of signal input, with a separate control box, indicated at 400 in FIG. 4A, which can be connected to the power module 80 via a cable 402 that can be, for example, a cable on the order of about 50 feet in length. Where control is provided by the pendent controller 400 then additional umbilical inputs can be provided via pin connections 10 and 11.

D. Operation

When a chamber 10 is delivered to a mine, the tracks 202/204 can be used to unload it from a transport and to then drive the chamber 10 into a mine through a road system. No other device is needed to maneuver the chamber 10 and one individual can easily control the movement and positioning thereof. As small obstacles are encountered the front and rear elevation of chamber 10 can be tilted to override that obstacle and to thereby avoid being stuck thereon or thereby. By use of its own drive system the chamber 10 can be constructed without concerns about weight, and further chamber 10 can be stocked with supplies, tools, monitoring equipment, water, and other materials that might otherwise not be included due to weight issues. Also, by having the ability to move chamber 10 by tracks 202/204 an operator not only has full control over its movement, but it is easily moved as a mine face recedes, and it can be moved in a way that is gentle and protective of on-board supplies, monitoring equipment, air cylinders, CO2 systems, water systems, piping, flow meters, and all other equipment that is sensitive to shocks and motion that could be resulting from deployment of such chambers.

When introducing elements of various aspects of the present invention or embodiments thereof, the articles "a," "an," "the" and "said" are intended to mean that there are one or more of the elements, unless stated otherwise. The terms "comprising," "including" and "having," and their derivatives, are intended to be open-ended terms that specify the presence of the stated features, elements, components, groups, and/or steps, but do not exclude the presence of other unstated features, elements, components, groups, and/or steps and mean that there may be additional features, elements, components, groups, and/or steps other than those listed. Moreover, the use of "top" and "bottom," "front" and "rear," "above," and "below" and variations thereof and other terms of orientation are made for convenience, but does not require any particular orientation of the components. The terms of degree such as "substantially," "about" and "approximate," and any derivatives, as used herein mean a reasonable amount of deviation of the modified term such that the end result is not significantly changed. For example, these terms can be construed as including a deviation of at least +/−5% of the modified term if this deviation would not negate the meaning of the word it modifies.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A refuge chamber comprised of an internal frame and an outer housing having top, side, end and bottom walls connected thereto, at least one entry port providing access into an interior space within the chamber, said interior space including a plurality of interior chambers with one of the interior chambers being an entry purge chamber, an air system operatively connected to the plurality of interior chambers, a power supply, storage areas provided within the interior space that are accessible from within at least one of the plurality of interior chambers a drive mechanism including a mounting assembly and tractor assemblies with the mounting assembly being attached to each side of the chamber and the tractor assemblies providing a motive force and clearance is provided between the bottom wall and a supporting surface, so that the refuge chamber is movable thereby, a chamber height adjusting mechanism positioned adjacent the drive mechanism on each side of the chamber and operating between the drive mechanism mounting assembly and the internal frame; and a control system for controlling the drive mechanism and the chamber height adjusting mechanism.

2. The refuge chamber as in claim 1 wherein height adjusting mechanism comprises a tilt assembly positioned adjacent one end of the drive mechanism that will pivot the chamber relative to a pivot point so that the height of a front end or a rear end of the chamber is movable relative to the supporting surface.

3. The refuge chamber as in claim 2 wherein the height of the front or rear end is lowered or raised to provide a modified height profile.

4. The refuge chamber as in claim 1 wherein height adjusting mechanism raises the whole chamber relative to the supporting surface.

5. The refuge chamber as in claim 1 wherein the drive mechanism is driven by hydraulic motors powered by a hydraulic system.

6. The refuge chamber as in claim 5 wherein the hydraulic system includes a hydraulic fluid reservoir, a hydraulic pump, and a hydraulic control system operatively interconnecting the hydraulic motors thereto.

7. The refuge chamber as in claim 1 further including a water system, a $CO_2$ absorption and a communication system each being operatively positioned within the chamber.

8. The refuge chamber as in claim 1 further including a lighting system within the chamber.

9. The refuge chamber as in claim 1 wherein the chamber is provided with a positive internal pressure.

10. The refuge chamber as in claim 1 wherein the entry port comprises a sealed hatch and a second sealed hatch is provided between the entry purge chamber and a main internal chamber.

11. The refuge chamber as in claim 10 wherein the entry port comprises a marine sealed hatch and further including a sealed glass portal adjacent the entry port.

12. The refuge chamber as in claim 1 comprises a crawler tractor device that includes movable tracks arranged to be independently driven in forward and rearward directions.

13. A refuge chamber comprised of an outer housing having top, side, end and bottom walls, at least one entry port providing access into an interior space within the chamber, said interior space including a plurality of interior chambers with one of the interior chambers being an entry purge chamber, an air system operatively connected to the plurality of interior chambers, a power supply, storage areas provided within the interior space that are accessible from within at least one of the plurality of interior chambers a drive mechanism attached to the chamber and providing a motive force and clearance is provided between the bottom wall and a supporting surface, so that the refuge chamber is movable thereby, and a control system for controlling the drive mechanism, wherein the power supply is removably attached to the chamber and includes a reservoir for hydraulic fluid, a motor driven hydraulic pumps, a hydraulic fluid cooler, and a control signal input assembly.

14. The refuge chamber as in claim 13 wherein the control signal input assembly comprises a set of control levers.

15. The refuge chamber as in claim 13 wherein the control signal input assembly comprises a pendent signal input device and a cable connection to the control system.

16. The refuge chamber as in claim 13 wherein the electrical control system includes manual signal inputs.

17. The refuge chamber as in claim 16 wherein the manual inputs are entered by way of a pendent control assembly.

18. A refuge chamber comprised of an outer housing having top, side, end and bottom walls, at least one entry port providing access into an interior space within the chamber, said interior space including a plurality of interior chambers with one of the interior chambers being an entry purge chamber, an air system operatively connected to the plurality of interior chambers, a power supply, storage areas provided within the interior space that are accessible from within at least one of the plurality of interior chambers a drive mechanism attached to the chamber and providing a motive force and clearance is provided between the bottom wall and a supporting surface, so that the refuge chamber is movable thereby, a control system for controlling the drive mechanism; and wherein the control system comprises a hydraulic control system and an electrical control system that includes a control signal input device located externally of the chamber.

* * * * *